US006235111B1

(12) United States Patent
Comiso et al.

(10) Patent No.: US 6,235,111 B1
(45) Date of Patent: May 22, 2001

(54) CLOSED-LOOP PHOSPHATIZING SYSTEM AND METHOD

(75) Inventors: Scott A. Comiso, San Francisco; Vincent J. Ferrari, Foster City; Neil J. Bailer, Redwood City; Michael D. Damron; Nhan Nguyen Thanh Lam, both of San Jose, all of CA (US)

(73) Assignee: EZ Environmental Solutions, Corporation, Menlo Park, CA (US)

( * ) Notice: Subject to any disclaimer, the term of this patent is extended or adjusted under 35 U.S.C. 154(b) by 0 days.

(21) Appl. No.: 09/200,221

(22) Filed: Nov. 25, 1998

(51) Int. Cl.[7] ..... B05B 7/00; B05B 9/00; B05C 3/09; B08B 3/08; C23C 22/07

(52) U.S. Cl. ..... 118/300; 118/226; 118/302; 134/105; 134/111; 148/253; 239/127

(58) Field of Search ..... 134/111, 105; 118/302, 300, 326; 417/40; 148/253, 256; 239/124, 127

(56) References Cited

U.S. PATENT DOCUMENTS

| | | | | |
|---|---|---|---|---|
| 3,615,895 | * | 10/1971 | Freyhold | 148/6.15 R |
| 3,906,895 | | 9/1975 | Morino et al. | 118/326 |
| 3,911,938 | | 10/1975 | Wiltrout | 134/104 |
| 5,063,949 | * | 11/1991 | Yates | 134/60 |
| 5,403,490 | * | 4/1995 | Desai | 210/652 |
| 5,433,773 | * | 7/1995 | Harelstad | 106/14.13 |
| 5,904,786 | * | 5/1999 | Wendel et al. | 148/262 |
| 5,931,174 | * | 8/1999 | Salas et al. | 134/89 |
| 5,954,070 | * | 9/1999 | Abad et al. | 134/89 |
| 6,120,614 | * | 9/2000 | Damron et al. | 134/10 |

FOREIGN PATENT DOCUMENTS

| | | |
|---|---|---|
| 2656103 | 12/1976 | (DE) . |
| 2726227 | 12/1978 | (DE) . |
| 2006267 | 5/1979 | (EP) . |
| 1262402 | 7/1960 | (FR) . |
| 2348984 | 11/1977 | (FR) . |
| 52-70950 | 6/1977 | (JP) . |
| WO99/25496 | 5/1999 | (WO) . |

OTHER PUBLICATIONS

Max Drkosch, "Gleichzeitig Reinigen und Beschichten Auftragen feinkristalliner Phosphatschichten und Entfetten mit einem Hochdruckstrahl" vol. 92, No. 24, 1986, pp. 52–54.

* cited by examiner

*Primary Examiner*—Richard Crispino
*Assistant Examiner*—J. A. Lorengo
(74) *Attorney, Agent, or Firm*—Beyer Weaver & Thomas

(57) ABSTRACT

A phosphatizing system for phosphatizing an object including a closed-loop phosphatizing assembly is provided configured to pass a phosphatizing reagent solution over an object during a phosphatizing procedure. The phosphatizing assembly includes a collection compartment in fluid communication with a run-off portion of a subfloor assembly supporting the object for receipt of substantially all the reagent run-off fluids from the subfloor assembly. A storage assembly is configured to pass a rinsing solution over the object to wash the reagent solution therefrom during a finishing rinse procedure performed after the phosphatizing procedure. This storage assembly includes a storage compartment in fluid communication with the run-off portion for receipt of substantially all the rinsing/reagent run-off fluids from the subfloor assembly. A fill pump, in fluid communication between the collection compartment and the storage compartment, is provided to transfer rinsing/reagent run-off fluids collected in the storage compartment to the collection compartment when the reagent solution contained therein drops below a predetermined operational fluid level.

33 Claims, 5 Drawing Sheets

CLOSED-LOOP PHOSPHATIZING SYSTEM AND METHOD

BACKGROUND OF THE INVENTION

1. Field of Invention

The present invention relates generally to methods and apparatus for use in phosphatizing. More particularly, the present invention relates to methods and apparatus for phosphatizing objects with a closed loop pressure washer and phosphatizer system, or similar device, and recovering and recycling rinse solution to replenish evaporated phosphatizing solution.

2. Description of the Relevant Art

Contamination of the environment by man-made substances has been considered a serious problem for a long time. Recently, concern about contamination of earth, air, and groundwater by oil, toxic chemicals, and other hazardous wastes has expanded beyond large-scale industry to encompass the activities of many small businesses including automobile service stations, and many others. Both government regulations and social outcry have placed tremendous pressure on these businesses to avoid discharging hazardous wastes into the environment in the course of ordinary business activities.

Many businesses partake in activities which are likely to produce waste which may be harmful to the environment. For example, in an automobile service station, washing or steam-cleaning auto parts, e.g., an automobile engine, often causes engine oil, gasoline, and other chemicals to enter a storm drain system, or other waterways, thereby leading to the potential contamination of groundwater. In addition, those who service remotely located equipment generally have a need to wash the equipment without discharging hazardous waste into the environment. By way of example, persons who service roofmounted air conditioners that contain lubricating petrochemicals, trapped pollutants, or other chemicals are not permitted to wash the equipment in a manner that could cause chemicals to run off the roof and into the surrounding environment.

These environmental concerns also apply to phosphatizing metal objects which is a pre-treatment process of metal for powder coating or wet painting. More specifically, in this process, a low concentration of phosphate solution reacts with the iron in the composition to create an iron phosphate coating. Similar to iron oxidation, the phosphate binds up with the site to form a coating which prevents further oxidation. Thus, this surface oxidation or etching creates an acceptable porous surface for the powder coating to statically adhere to the metal, and an acceptable surface for wet painting. Subsequently, the powder is heat cured to bond the powder to the treated surface.

Phosphatizing is usually a commercial multi-stage procedure where the main process of phosphatizing is typically performed through a dipping bath or spraying application. Generally, phosphatizing is performed by large commercial establishments having relatively large and costly conveyor-type systems which move the metallic objects to be phosphatized systematically through each process stage. Depending upon the quality of the paint desired, more intermediate stages are added which increases the quality of the painting. In these costly conveyor-type assemblies, however, the primary stages prior to powdering usually include a cleaning process, a phosphatizing process, and a finishing rinse.

The cleaning stage is usually performed using a heated spray application of water to the surface of the object under high pressures of between about 500 psi to about 2500 psi, depending upon the metal composition. This washing procedure removes any loose particles, surface oils or the like which may adversely affect the formation of the iron phosphate coating on the metallic surface during the phosphatizing stage. In conveyor-type systems, such high pressure cleaning is usually applied by spraying the object through pressurized nozzles strategically located about the conveyor assembly in the cleaning station. Since these nozzles are usually fixed relative the conveyor assembly, cleansing coverage of the metallic object is often limited.

The next stage of the procedure is the phosphatizing step where the pressure cleaned objects are phosphatized using a primarily heated solution of 1% to 5% phosphoric acid solution. Chemical constituents of phosphate solution will vary from manufacturer to manufacturer.

In large conveyor-type systems, this stage is usually applied in a spray application to bath the object in the phosphate solution. Similar to the washing station, the phosphatizing station includes a plurality of strategically placed spray nozzles fixed about the station. Therefore, coverage of the phosphate solution on the object is limited in the same manner as in the washing bath. To some extent, this limits the coverage dimensions of iron phosphate coating which is dependent upon several factors including the phosphate concentration, the coverage of the spray application and the amount of reaction time.

The final stage of the phosphatizing process is the finishing rinse stage where de-ionized water is preferably employed to rinse the phosphoric acid solution from the object to inhibit further phosphatizing of the object surface. In effect, this finishing rinse procedure halts the reaction by removing the phosphatizing reagent from the surface of the coated object. It is important, however, to rinse the phosphatized object from a source of continuous clean de-ionized water to assure proper rinsing of the object. De-ionized water even slightly contaminated with phosphoric acid will not properly halt further reaction of the phosphatizing process. Thus, this rinsing solution must not be reused, and is discarded after use.

Due to environmental restrictions, this contaminated refuse must be treated before being discarded into the environment. Thus, hazardous waste disposal units must be contracted, or other costly disposal processes are applied such as the application of phosphate neutralizers to the waste before being discarded. In other instances, evaporators or the like must be employed to evaporate the water, leaving hazardous solid phosphates wastes for removal.

While these large conveyor-type phosphatizing systems are adequate for large commercial establishments with large productions, they are not practical for most mid-size or smaller establishments with substantially less resources and production capabilities. For one, these systems are relatively costly and require relatively large areas of manufacture space. Further, the maintenance costs of the systems is substantial. For example, the recommended use of de-ionized water for the washing, phosphatizing and rinsing stage collectively results in substantial production costs. Due to the volume of de-ionized solutions employed in each stage, water de-ionizing units to de-ionize tap water are employed as a continuous source of de-ionized water. However, this process itself is time consuming and costly to maintain. The Resin beds necessary to de-ionize the water are expensive and are easily contaminated. Thus, replacement is very frequent.

Thus, many phosphatizing units attempt to conserve the de-ionized water or even eliminate the use of de-ionized water. Regular tap water may be utilized to replace the costly de-ionized water in one of or all of the cleaning, phosphatizing and finishing rinse stages. This replacement, however, is often not recommended since the amount of dissolved solids/contaminants in the tap water vary depending upon the water source. Moreover, during the evaporation/replenishing cycles of tap water in phosphate solution, the build-up of dissolved solids/contaminants in the phosphate solution adversely affects the cleaning process. Thus, it is preferred to employ de-ionized water in both the cleaning, the phosphatizing and the finishing rinse procedures to reduce the number of dissolved solids/contaminants in the phosphate solution.

In other phosphatizing procedures, the rinse stage may be eliminated altogether. This technique is problematic, however, since it is then difficult to control the depth of the iron phosphate coating. Accordingly, while these cost savings applications reduce production costs, the quality of the phosphatizing is jeopardized in most instances.

One promising application is to combine the cleaning spray stage and the phosphatizing stage into one cleaning/phosphatizing stage. The primary problem with this application, however, is that the relatively high pressure of the spray application to clean the object is also too high to retain the build up of the iron phosphate coating. Thus, the coating is continuously blasted off the surface. The distribution of the iron phosphate coating on the object, consequently, tends to be more uneven.

Another problem associated with this approach is that the source of heated solution of phosphoric acid must be constantly monitored and periodically replenished. Depending upon the chemical manufacturers specifications of the phosphoric acid solution, the recommended operating temperature is usually in the range of about 120° F. to about 160° F. Thus, the evaporation rate is relatively high which ultimately results in a substantial loss of the water in the phosphatizing solution.

SUMMARY OF THE INVENTION

The present invention relates to a phosphatizing system for phosphatizing an object including a subfloor assembly for supporting an object to be sprayed which is further adapted to direct excess run-off fluids which are flowed over the object towards a run-off portion thereof. A closed-loop phosphatizing assembly is provided configured to pass a phosphatizing reagent solution over the object during a phosphatizing procedure. The phosphatizing assembly includes a collection compartment in fluid communication with the run-off portion for receipt of substantially all the reagent run-off fluids from the subfloor assembly. The phosphatizing system of the present invention further includes a storage assembly configured to pass a rinsing solution over the object to wash the reagent solution therefrom during a finishing rinse procedure performed after the phosphatizing procedure. This storage assembly includes a storage compartment in fluid communication with the run-off portion for receipt of substantially all the rinsing/reagent run-off fluids from the subfloor assembly. A fill pump is further included which is in fluid communication between the collection compartment and the storage compartment to transfer rinsing/reagent run-off fluids collected in the storage compartment to the collection compartment when the reagent solution contained therein drops below a predetermined operational fluid level.

In one embodiment, a transfer compartment is provided in fluid communication between the runoff-portion, the collection compartment and the storage compartment for selective diversion of the reagent run-off fluids to the collection compartment and the rinsing/reagent run-off fluids to the storage compartment. The transfer compartment preferably includes a valve mechanism movable between a first position and a second position. In the first position, the reagent run-off fluids are directed to the collection compartment, while in the second position, the rinsing/reagent run-off fluids are directed to the storage compartment.

In another embodiment, the phosphatizing further includes a transfer pump in fluid communication between the transfer compartment and the valve mechanism to pump the run-off fluids from the transfer compartment to one of the collection compartment and the storage compartment. In yet another aspect, the transfer compartment includes a fluid sensor configured to detect the presence of run-off fluids in the transfer compartment. In response to runoff fluid detection, the fluid sensor communicates with the transfer pump for operation thereof. A timer device may be provided coupled to transfer pump to delay the shut-off thereof for a predetermined time period when the fluid sensor detects the non-presence of the run-off fluids in the transfer compartment.

The phosphatizing procedure and the finishing rinse procedure, in yet another aspect, are performed through spray applications. The reagent solution includes a phosphoric acid component and a de-ionized water component, while the rinsing solution is composed of de-ionized water.

An auto-fill device may be included which is adapted to automatically operate the fill pump upon detection of the reagent solution fluid level in the collection compartment falling below the predetermined operational fluid level. The storage assembly further includes an maximum level sensor for sensing a predetermined maximum level of collected rinsing/reagent solution in the storage compartment, and a minimum level sensor for sensing a predetermined minimum level of the collected rinsing/reagent. The minimum level sensor is communicably coupled to the fill pump to shut-off the same upon detection of the rinsing/reagent fluid level of the collected rinsing/reagent solution being below the predetermined lower level.

In another configuration, a method is provided for phosphatizing an object with a reagent solution including the steps of: supporting the object through a subfloor assembly including a support floor having a run-off portion thereof; and performing a phosphatizing procedure on the object through a phosphatizing assembly by passing a phosphatizing reagent solution over the object. The method of the present invention further includes the steps of directing excess reagent run-off fluids into a collection compartment of the phosphatizing assembly for reuse thereof; and after the performing a phosphatizing procedure step, performing a finishing rinse procedure on the object through a storage assembly by passing a rinsing solution over the object. The next steps include directing excess rinsing/reagent run-off fluids into a storage compartment of the storage assembly; and selectively transferring a portion of the rinsing/reagent run-off fluids collected in the storage compartment to the collection compartment when the reagent solution contained therein drops below a predetermined operation In one embodiment of the method of the present invention, the phosphatizing step includes the step of spraying the object, while the rinsing step includes the step of spraying the object with a rinsing solution of uncontaminated de-ionized water.

In one embodiment, before the first directing step and the second directing step, the method includes the step of flowing the run-off fluids into a transfer compartment in fluid communication between the runoff-portion, the collection compartment and the storage compartment for selective diversion of the reagent run-off fluids to the collection compartment and selective diversion of the rinsing/reagent run-off fluids to the storage compartment, respectively.

Another aspect of the method of the present invention, the first directing step and the second directing step are performed by a valve mechanism movable between a first position, allowing passage of the run-off fluids to the collection compartment while simultaneously preventing passage thereof to the storage compartment, and a second position, allowing passage of the run-off fluids to the storage compartment while simultaneously preventing passage thereof to the collection compartment.

The method of the present invention further includes the step of detecting the presence of run-off fluids in the transfer compartment, and in response to runoff fluid detection, operating the transfer pump for one of the first pumping step and the transfer pumping step. Moreover, the method includes the step of delaying the shut-off of the transfer pump for a predetermined time period when the non-presence of the run-off fluids in the transfer compartment are detected.

In still another configuration, the method includes the step of automatically performing the transferring step upon detection of the reagent solution fluid level in the collection compartment falling below the predetermined operational fluid level.

BRIEF DESCRIPTION OF THE DRAWINGS

The method and assembly of the present invention has other objects and features of advantage which will be more readily apparent from the following description of the Detailed Description of the Embodiments and the appended claims, when taken in conjunction with the accompanying drawing, in which:

DETAILED DESCRIPTION OF THE EMBODIMENTS

Figure 1:
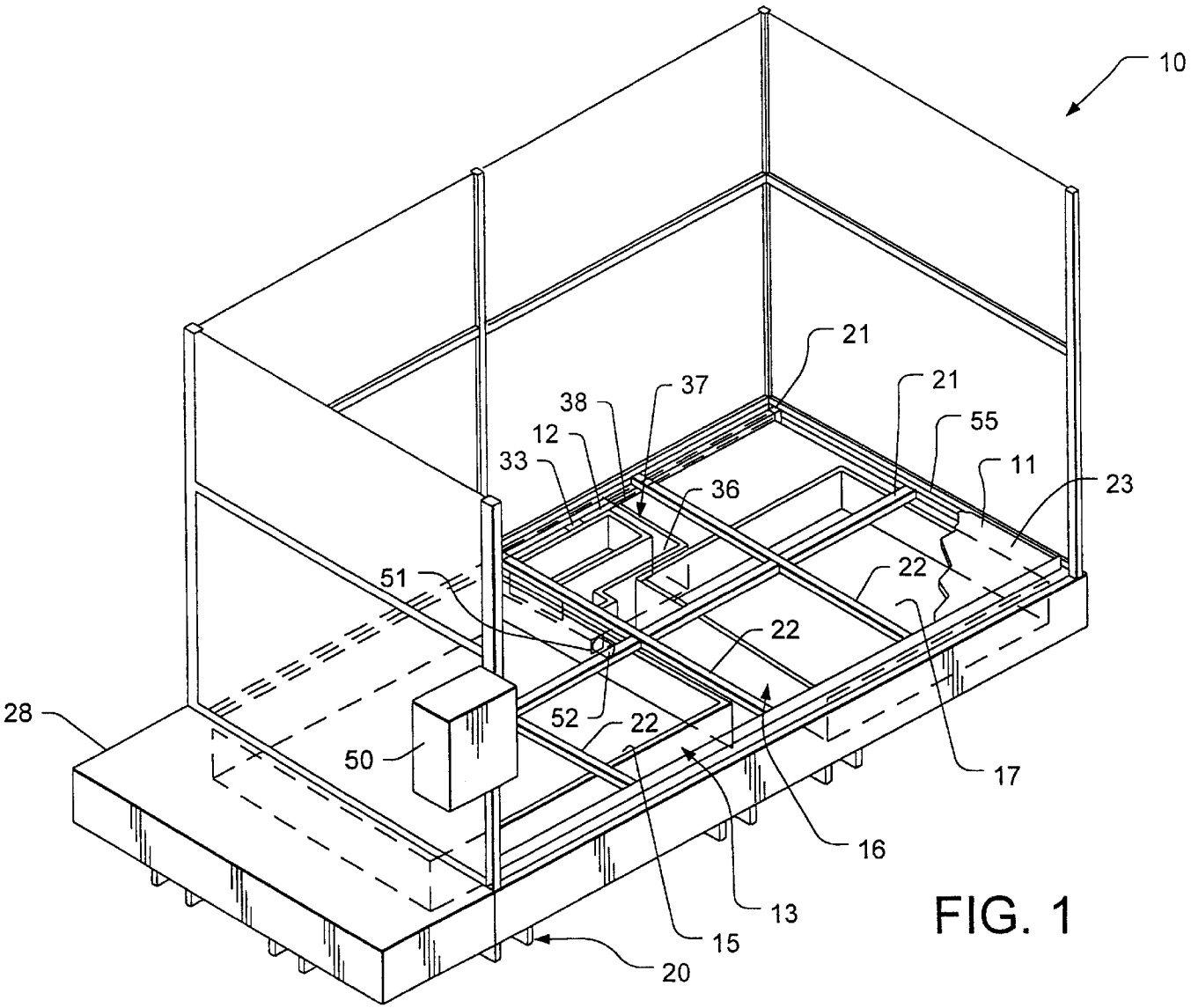
FIG. 1 is a top perspective view a phosphatizing system constructed in accordance with the present invention.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various figures.

Figure 2:
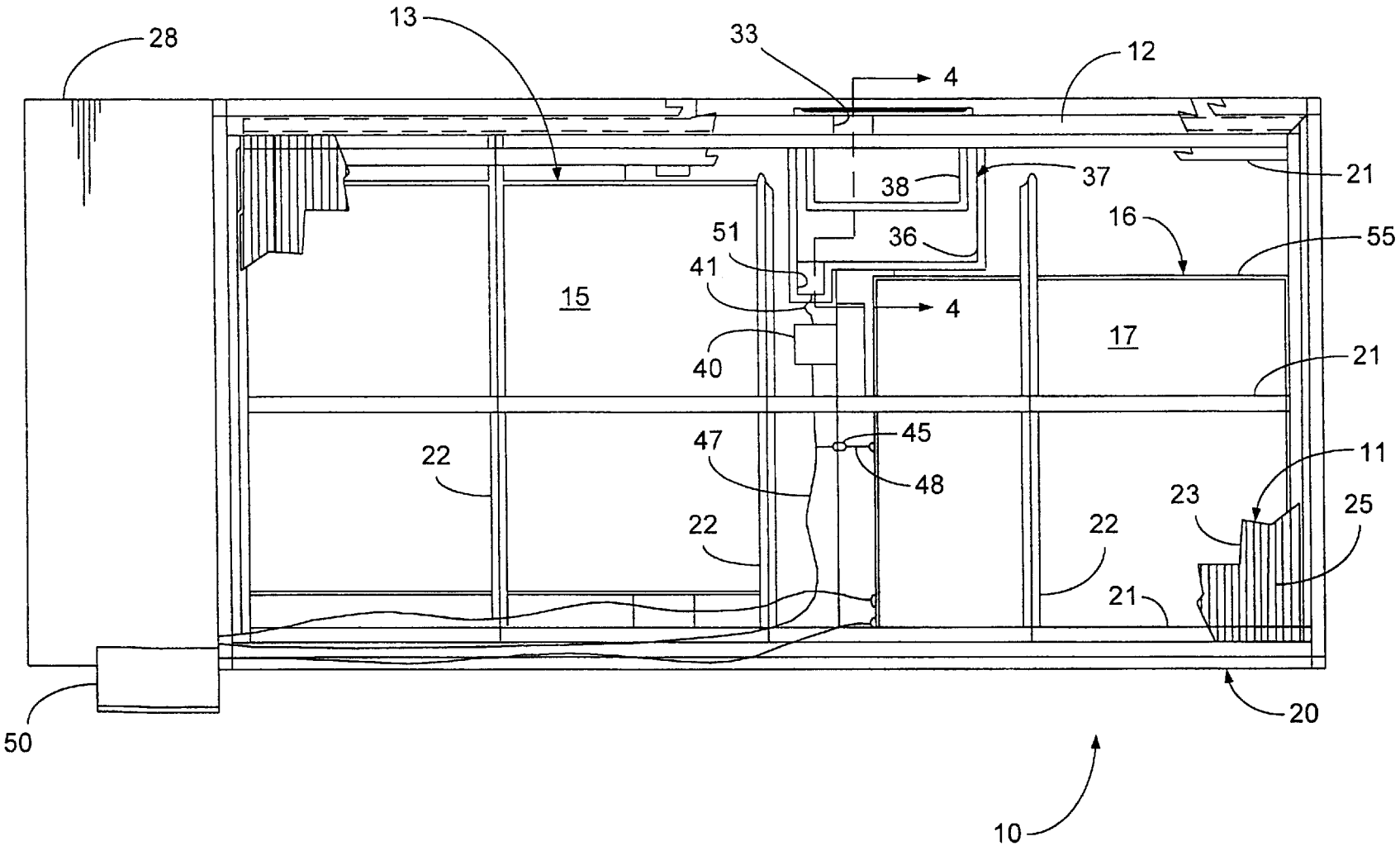
FIG. 2 is an enlarged top plan view, partially broken-away, of the phosphatizing system of FIG. 1.
Figure 3:
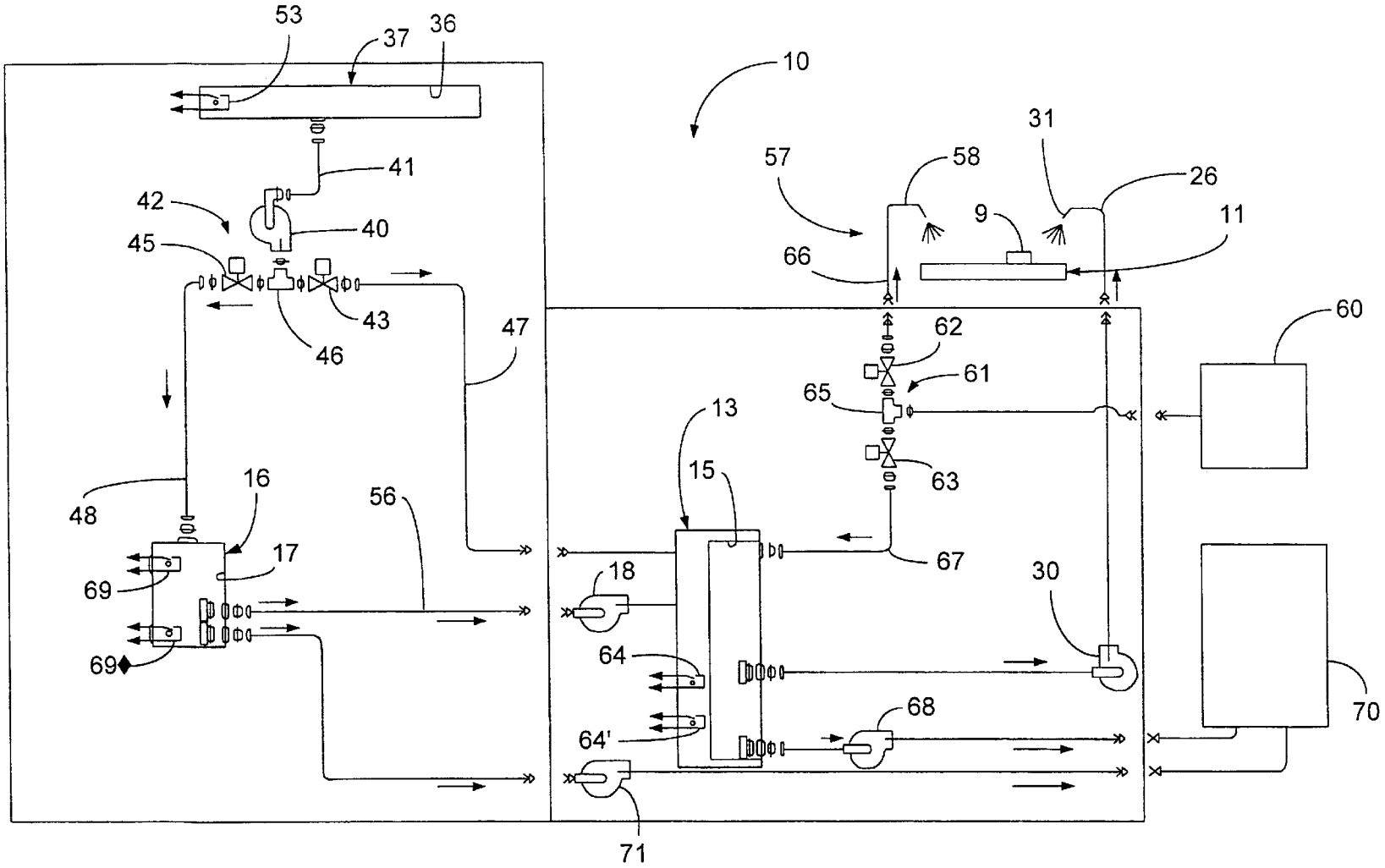
FIG. 3 is a schematic view of the phosphatizing system of FIG. 1.

Attention is now directed to FIGS. 1–3 where a cleaning system, generally designated 10 is illustrated for cleaning an article or object 9 supported atop a subfloor assembly 11. The subfloor assembly 11 is further adapted to direct excess run-off fluids which are flowed over the object 9 towards a run-off portion 12 thereof. A closed-loop cleaning assembly, generally designated 13, is configured to pass a wetting solution over the object during a cleaning procedure. Cleaning assembly 13 includes a collection compartment 15 in fluid communication with the run-off portion 12 of the subfloor assembly 11 for receipt of substantially all the wetting run-off fluids collected thereon. The cleaning system 10 of the present invention further includes a storage assembly, generally designated 16, which is configured to pass a rinsing solution over the object to wash the wetting solution therefrom during a finishing rinse procedure performed after the cleaning procedure. This storage assembly 16 includes a storage compartment 17 in fluid communication with the run-off portion for receipt of substantially all the rinsing/wetting run-off fluids from the subfloor assembly 11. A fill pump 18 is in fluid communication between the collection compartment 15 and the storage compartment 17 to transfer the rinsing/wetting run-off fluids collected in the storage compartment 17 to the collection compartment 15 when the wetting solution fluid level of the wetting solution contained therein falls below a predetermined operational fluid level.

Accordingly, a cleaning system is provided which allows an operator to perform multiple pretreatment processes on an object 9 utilizing one cleaning area. More preferably, the pretreatment process relates to phosphatizing an object as a pretreatment to powder coating. Thus, in these examples, the wetting solution is preferably provided by a phosphatizing reagent solution containing as primary components, about a 1% to 5% concentration of phosphoric acid and de-ionized water. The rinsing solution, on the other hand, is preferably provided by uncontaminated de-ionized water. The phosphatizing procedure and the finishing rinse procedure may be operated on the present invention using regular tap water, but de-ionized water is preferred for the best results. It will further be appreciated, that the phosphatizing system of the present invention may be applied to other multi-liquid cleaning applications, such as an alkaline cleaner process or the like. In this example, an alkaline reagent solution is employed as a wetting solution while de-ionized water is employed as a rinsing solution.

As above-mentioned, due to the high evaporation rate of the heated reagent solution contained in the collection compartment of the phosphatizing assembly 13, the heated reagent solution must be frequently and periodically replenished. Rather than replenish the evaporated reagent solution with uncontaminated de-ionized water, as the current systems employ, the present invention transfers a portion of the rinsing/reagent solution, collected in the storage compartment 17 during the finishing rinse procedure, into the collection compartment 15 for reuse in a subsequent phosphatizing procedure. The present invention is thus substantially more cost efficient since the amount of uncontaminated de-ionized water consumed is reduced. This reuse is further beneficial because the amount of discarded rinsing/reagent solution that requires treatment before discarding is also reduced.

Referring now to FIG. 1, cleaning system 10 includes a base frame 20 which is a generally rectangular structure comprising four base side frames, although it should be appreciated that base frame 20 may take on any suitable shape. The base frame 20 preferably includes an upper support frame having lateral beams 21 that are joined to cross beams 22 which are formed and dimensioned to support the subfloor assembly 11 above the phosphatizing assembly 13 and the storage assembly 16. It will be understood, however, that these assemblies do not need to be positioned underneath the subfloor. The lateral beams 21 and the cross beams 22 may be welded aluminum tube stock, structural fiberglass, as for example EXTREN®, which is commercially available from MMFG, or any other lightweight, sturdy material which is essentially non-conductive and non-corroding.

The subfloor assembly 11 further includes a support floor 23 (FIG. 4) and a metal or fiberglass grate assembly 25 positioned thereatop. The grate assembly 25 supports the object so that it does not come into direct contact with the support floor 23, which itself is configured to collect the excess runoff fluids during the phosphatizing and finishing rinse procedures. Both the grate assembly and the support floor 23 are adapted to be lifted off the lateral beams 21 and the cross beams 22 to enable access to the phosphatizing assembly 13 and the storage assembly 16 positioned below. Hence, the articles to be washed can be supported atop this grate and over the subfloor assembly 11 for cleaning.

Figure 5:
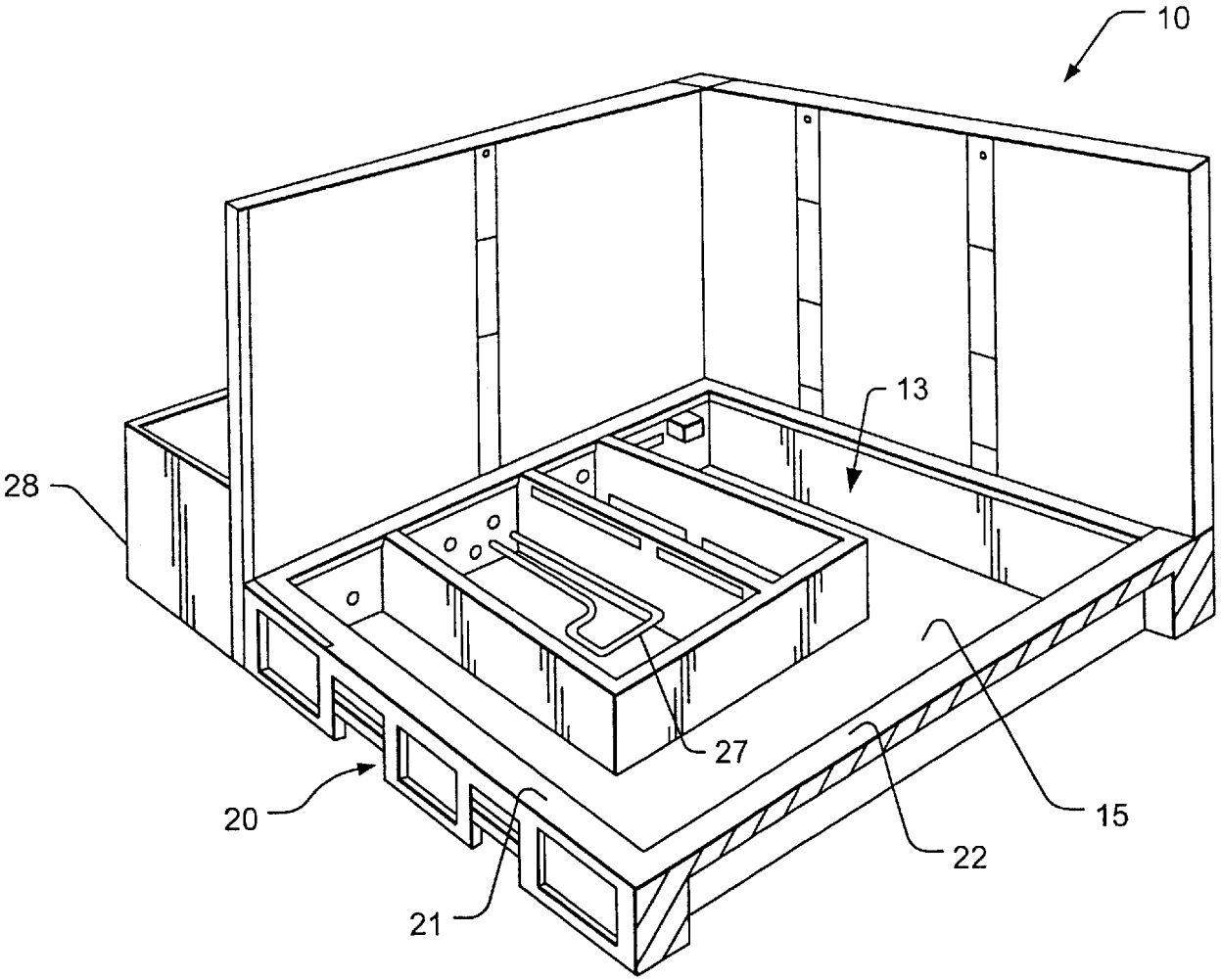
FIG. 5 is a top perspective view of a closed-loop pressure cleaning and phosphatizing assembly employed with the phosphatizing system of FIG. 1.

In the preferred embodiment, a pressure cleaning procedure and the phosphatizing procedure are combined in a single cleaning/phosphatizing procedure using a spray application of a low concentration phosphoric acid solution for both cleaning and phosphatizing applications. This cleaning/phosphatizing assembly 13, as shown in FIG. 5, preferably employs a closed-loop pressure cleaning system adapted for spray applications using conventional pressure wands 26 (FIG. 3). Briefly, these closed-loop cleaning/phosphatizing assemblies 13 are adapted to recirculate the reagent solution in the collection compartment 15 in a manner systematically filtering out contaminants contained in the recirculated reagent solution. The oils may also be skimmed off the surface, and the reagent solution may further be urged through a bag filter (not shown). Typical of these systems is provided in our U.S. patent application Ser. No. 09/145,481, filed Sep. 1, 1998, entitled "METHOD AND APPARATUS FOR PRESSURE WASHING", and incorporated herein by reference in its entirety.

By providing an adequate settling time and a relatively slow recirculation flow in the collection compartment, the contaminants may be separated from the reagent solution through gravity filtration. Thus, these collection compartment configurations enable the natural separation of the lightweight components from the heavyweight components suspended in the collected reagent solution in the collection compartment 15 (FIG. 5). Briefly, by providing a flow path which is relatively slow (about 0.5 gallons/min. to about 8.5 gallons/min, and more preferably about 2.0 gallons/min.), relatively non-turbulent and uniform, separation of the contaminants can naturally occur.

Thus, the slow recirculating reagent solution in the collection compartment 15 is constantly filtering out contaminants contained therein as the solution recirculates through the system. The cleaning/phosphatizing assembly 13 further heats the reagent solution through a heating element 27 which is in fluid communication with the reagent solution in the collection compartment. This heating element 27 preferably heats the reagent solution to a temperature in the range of about 120° F. to about 160° F. for pressure cleaning thereof. Thus, the evaporation rate of the recirculating reagent solution in the collection compartment 15 is relatively high, and ultimately results in a substantial loss of the phosphatizing reagent solution. The temperature of the reagent solution, of course, may be selectively varied to conform to manufacturer and chemical specifications of the phosphatizing reagent solutions employed.

A support housing 28 contains most of the necessary plumbing, motors, pumps etc. (not shown) to operate the cleaning/phosphatizing assembly 13 of FIG. 5. Moreover, the spray application is provided by a pressure spray wand 26 having a high pressure pump 30 (FIG. 3) in fluid communication with the reagent solution. This pressure pump 30 may be any conventional high pressure pump assembly, and is preferably capable of providing a variable pressure for a selective pressure spray application. One such conventional pressure pump, for example, is that provided by WANNER, Model No. MD3EABJSSECA, which is capable of providing a low pressure spray in the range of about 50 psi and a high pressure spray in the range of about 3000 psi.

In the preferred form, the combined cleaning/phosphatizing procedure is comprised of a high pressure cleaning procedure and a low pressure phosphatizing procedure using the common heated reagent solution. Applying a stainless steel spray nozzle 31 and spray wand 26 (FIG. 3), for compatibility purposes, the operator can direct a high pressure spray of the heated reagent solution at the object 9 for a thorough cleaning. This high pressure cleaning procedure removes any loose contaminants, surface oils, etc., from the surface of the metallic object 9 to be cleaned. Preferably, for the combined cleaning/phosphatizing procedure, the reagent solution is maintained at a substantially high temperature in the range of about 8° F. to about 212° F. and more preferably in the range of about 140° F. to about 160° F., while the high pressure spray is maintained in the range of about 100 psi to about 3000 psi.

While the cleaning procedure is preferably performed using a high pressure spray application, such high pressure is not suitable for the phosphatizing procedure since this high pressure spray would also remove iron phosphate coating formation on the surface of the object 9. Therefore, once the cleaning procedure is completed, the cleaning assembly switches the spray application to a low pressure spray application to merely soak or wet the object surface with the same phosphatizing reagent solution. This low pressure spray application is preferably performed in the range of about 20 psi to about 200 psi. Thus, while a spray application is preferred, any other wetting technique may be employed to introduce the reagent solution to the object surface during the phosphatizing procedure.

Accordingly, the cleaning and phosphatizing system of the present invention can accommodate a wide variety of operational requirements. Depending upon the composition of the materials being cleaned or phosphatized, the drain, flow, rinse, and phosphatizing parameters are all variable, and can all be changed within the system.

Figure 4:
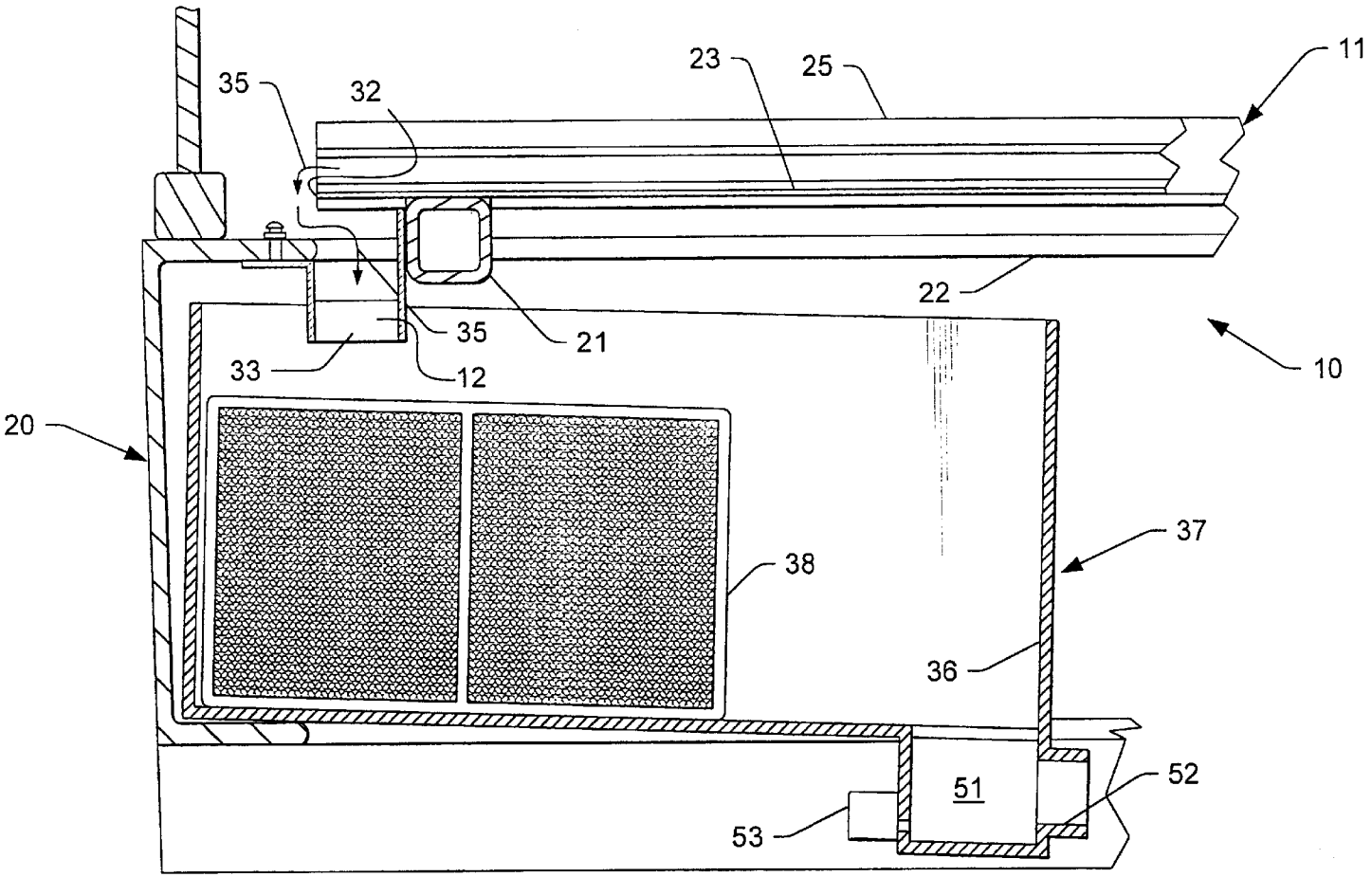
FIG. 4 is a fragmentary, enlarged side elevation view, in cross-section a the transfer assembly of the phosphatizing system, taken substantially along the plane of the line 4—4 in FIG. 2.

In accordance with the present invention, the excess reagent run-off fluids flowed over the object 9 are diverted back to the collection compartment where the fluid is reheated and cleaned for reapplication. Once the object is cleaned and wetted during the cleaning and phosphatizing spray applications, the excess run-off fluids flow onto the support floor 23 of the subfloor assembly 11. Briefly, it will be understood that during the finishing rinse procedure, the excess rinsing/reagent run-off fluids also flow onto the support floor as well. As best viewed in FIG. 4, this support floor 23 (removed from FIG. 2 for clarity) is preferably configured to gravity flow or funnel the run-off fluids toward subfloor assembly run-off portion 12 which is positioned at a rear side of the cleaning/phosphatizing system 10. This gravity flow is caused by a slight downward slope in the support floor 23 toward the run-off portion 12, or by sloping the entire base frame to direct the run-off fluids into the run-off portion 12 as shown in FIG. 4. The run-off portion 12, which extends laterally across the support floor, is preferably provided by a trough or gutter positioned below the rear edge 32 of the support floor 23. Similarly, the trough 12 is downwardly sloped for further gravity flow toward a funnel opening 33 in the trough, as represented by arrows 35 in FIG. 4. Any other fluid transfer techniques, however, may be employed without departing from the true spirit and nature of the present invention.

Once the run-off fluids pass through funnel opening 33, they are collected in a transfer compartment 36 of a transfer assembly 37. The function of this transfer assembly 37 is to transfer the respective phosphatizing reagent run-off fluids or the rinsing/reagent run-off fluids to either the phosphatizing assembly 13 or the storage assembly 16, depending upon whether the cleaning/phosphatizing procedure or the rinsing procedure is being performed (to be described in greater detail below). This compartment is preferably composed of polypropylene, and maintains a large capacity for solids removal.

To filter out larger contaminants from the run-off fluids (i.e., either the reagent run-off fluids or the rinsing/reagent run-off fluids) a filter device 38 is placed in the path of the flow of the run-off fluids into the transfer compartment 36. This filtering device 38 is preferably provided by a mesh filtering basket placed in the transfer compartment 36 (FIG. 4) which is adapted to filter out very coarse contaminants typically on the order of about fifty (50) thousandths of an inch and greater. Such coarse contaminants include dead phosphates, metal shards, and other debris resulting from the cleaning process. Different mesh sizes, of course, may be employed to accommodate filter out different substances.

Referring now to the schematic diagram of FIG. 3, the transfer assembly 37 includes a transfer pump 40 fluidly coupled to the transfer compartment by an inlet tube 41. This transfer pump 40 operates to pump or transfer the collected run-off fluids contained in the transfer compartment 36 to either the phosphatizing assembly 13, when in the cleaning/phosphatizing procedure is being performed, or to the storage assembly 16, when in the finishing rinse procedure is being performed. One such conventional transfer pump, for example, is that provided by ITT JABSCO, Model No. 30801-0115.

The outlet end of the transfer pump 40 is fluidly coupled to a transfer valve mechanism 42 of the transfer assembly 37 which in turn is in fluid communication with the collection compartment 15 on one side and the storage compartment 17 on the other side thereof. Preferably, the valve mechanism 42 is separated into two independent two-way fluid valves 43 and 45 positioned on the opposite sides of a T-joint 46. The phosphatizing valve 43 is fluidly coupled to the collection compartment 15 through a first transfer tube 47 while the storage valve 45 is fluidly coupled to the storage compartment 17 through a second transfer tube 48.

Accordingly, when the phosphatizing system 10 is operating during the cleaning/phosphatizing procedure, the storage valve 45 is in a "closed condition" to prevent fluid flow therethrough, while the phosphatizing valve 43 is in an "opened position". This "opened position" permits the transfer pump 40 to transfer the reagent run-off fluids from the transfer compartment 36 to the collection compartment 15 for recirculation thereof. In contrast, when the phosphatizing system 10 is operating the finishing rinse procedure, the phosphatizing valve 43 is in a "closed position" to prevent fluid flow therethrough, while the storage valve 45 is in an "opened condition". This "opened condition" permits the transfer pump 40 to transfer the rinsing/reagent run-off fluids from the transfer compartment 36 to the storage compartment 17 for collection therein.

It will be appreciated that the valve mechanism 42 may be provided by a single three-way valve fluidly coupled is the transfer compartment 36. This threeway valve would direct the run-off fluids in the transfer compartment to either the collection compartment 15 or the storage compartment, again, depending upon which procedure were being performed. However, employing two independent two-way valves is advantageous due to manufacturability.

It will further be appreciated that a control unit 50 (FIGS. 1 and 2) is provided which includes the proper circuitry and instruction sets to control all operations of the phosphatizing system. These instruction sets include the automated and manual operations of the spray pressures as well as the reagent solutions temperatures. Further, these controls operate the sequence of the valve mechanism 42 to divert the run-off fluids to either the collection compartment 15 or the storage compartment depending upon the respective procedure being performed.

In accordance with the present invention and as best viewed in FIGS. 1, 2, and 4, the transfer compartment 36 includes a lower level pocket portion 51 upon which collected run-off fluids in the transfer compartment funnel during operation of either the phosphatizing assembly 13 or the storage assembly 16. An outlet 52 in the pocket portion 51 is provided which is fluidly coupled to the transfer pump 40 for flow of the run-off fluids therefrom.

The transfer assembly further includes a fluid sensor 53 positioned proximate to a bottom of the pocket portion 51, and is formed to detect the substantial presence of fluids in the pocket portion 51, and hence the transfer compartment 36. Thus, since the horizontal cross-sectional dimension of the pocket portion 51 (as viewed from FIG. 2), is substantially smaller than the horizontal cross-sectional dimension of the primary portion of the transfer compartment 36, the absence of fluid detection by the fluid sensor in the lower level pocket portion 51 is a good indication of the complete evacuation of run-off fluids from the transfer compartment 36. This sensor 53 may be provided by a float switch, a or other such level indicators. Preferably, however, the fluid sensor 53 is provided by a capacitance proximity switch detector which is adapted to sense the presence of a dielectric, such as water.

In accordance with the present invention, when the fluid sensor 53 detects the presence of run-off fluids in the pocket portion 51, the control unit 50 instructs the transfer pump 40 to continue or to begin pumping operation thereof. Thus, depending upon whether the phosphatizing procedure is being performed or the finishing rinse procedure is being performed, the transfer pump 40 in cooperation with the valve mechanism 42 will transfer the respective run-off fluids to the respective compartment. When the presence of run-off fluids in the pocket portion 51 are no longer detected, the transfer pump is automatically shut-off. In this manner, when the operator is switching between the rinsing and the cleaning/phosphatizing procedures, they will know when to manually switch between the procedures with minimal cross-contamination of the respective compartments.

In the preferred embodiment, a timer device (not shown) is operably coupled to the transfer pump 40 and the fluid sensor 53 so that when the presence of runoff fluids are no longer detected, the timer device will delay the automatic shut-off of the transfer pump 40 for a predetermined time period. This arrangement enables continuous operation of the transfer pump to evacuate run-off fluids from the pocket portion 51 which continue to trickle into the transfer compartment after termination of the phosphatizing procedure or the finishing rinse procedure. For instance, when the operator has finished spraying an article during the phosphatizing procedure, the transfer pump 40 will continue to operate while the fluid sensor detects of the presence of reagent run-off fluid in the pocket portion 51. Upon non-detection of the run-off fluid therein, the timer device will delay the shut-off of the transfer pump 40 for the predetermined time period which allows a more complete evacuation of the remaining run-off fluids trickling into the transfer compartment. The preferred predetermined time period, depending upon the performance of the transfer pump 40 is preferably between about 5 seconds to 5 minutes.

Referring back to FIGS. 2 and 3, the storage assembly 16 includes a basin 55 defining the storage compartment 17, which is formed for receipt and temporary storage of the rinsing/reagent run-off fluids therein during the finishing rinse procedure. In the preferred embodiment, this basin 55 is composed of stainless steel or polypropylene, and has a capacity in the range of about 25 gallons to about 150 gallons. This capacity may of course vary depending upon the size of the phosphatizing system.

As set forth above, the storage compartment 17 is fluidly coupled to the transfer assembly 37 through the second transfer tube 48, the storage valve 45, the transfer pump 40 and the inlet tube 41. Moreover, the storage compartment 17 is fluidly coupled to the collection compartment 15 via a fill tube 56 and the fill pump 18.

In the finishing rinse procedure, a rinse assembly 57 (FIG. 3) is provided which includes a separate rinse spray wand 58 configured to spray off the phosphatizing reagent solution from the object surface, after the cleaning/phosphatizing procedure. Due to the sensitivity to potential crosscontamination of the rinsing solution, especially when de-ionized water is employed, a separate rinse spray wand 58 is preferred to the dual application of the pressure spray wand 26.

The rinsing spray wand 58 is coupled to rinse solution source 60 which provides pressurized spray application of uncontaminated rinsing solution. Preferably, the rinse solution source 60 is provided by a fresh de-ionized water source such as an ion-exchanger which generates de-ionized water. This is usually provided by a plurality of resin beds which convert tap water into de-ionized water. Another source could be reverse osmosis water or distilled water, for example.

A rinsing valve mechanism 61 of the rinse assembly 57 directs the uncontaminated de-ionized water to the rinse spray wand 58, during the finishing rinse procedure, and/or directs the uncontaminated de-ionized water to the collection compartment 15 of the phosphatizing assembly 13, during an auto direct supply procedure. Similar to the transfer valve mechanism 42, the rinsing valve mechanism 61 is preferably provided by two independent two-way fluid valves 62 and 63 positioned on the opposite sides of a T-joint 65. A rinse valve 62, for instance, is fluidly coupled to the rinse spray wand 58 through a first rinse tube 66, while a fill valve 63 is fluidly coupled to the storage compartment 17 through a second rinse tube 67.

Accordingly, when the rinse assembly 57 is operating during the finishing rinse procedure, the fill valve 63 is in a "closed condition" to prevent fluid flow therethrough. The rinse valve 62, however, is moved to an "opened position" to permit the rinse solution source 60 to supply uncontaminated rinse solution to the rinse spray wand 58. In contrast, when the phosphatizing system 10 requires an auto-fill of the collection compartment, as will be discussed below, the rinse valve 62 is moved to a "closed position" to prevent fluid flow therethrough, while the fill valve 63 is moved to an "opened condition". This "opened condition" permits the rinse solution source 60 to supply uncontaminated rinse solution to the storage compartment 17 for filling thereof.

Both the rinse valve 62 and the fill valve 63 may be closed when neither the rinse assembly nor the auto direct supply procedure is operational. Moreover, in some instances, both valves may in the opened state simultaneously.

Accordingly, during the finishing rinse procedure, the rinse valve 62 is in the "opened position" to enable the rinsing solution source 60 to supply de-ionized water to the rinsing spray wand 58 to rinse off the object 9 and halt or impede any further phosphatizing thereof. The excess rinsing/reagent run-off fluids collect upon the support floor 23 and are directed toward the run-off portion or trough 12. As viewed in FIG. 4 and represented by arrows 35, the rinsing/reagent run-off fluids collected in trough 12 are gravity induced to pass through funnel opening 33 and into the transfer compartment 36.

In this rinsing arrangement, the control unit 50 moves the phosphatizing valve 43 to the "closed position", while the storage valve 45 is moved to the "opened condition". Hence, when a sufficient amount of rinsing/reagent run-off fluid is collected in the pocket portion 51 of the transfer compartment 36, the transfer pump 40 in cooperation with the transfer valve mechanism 42 will pump the run-off fluid into the storage compartment 17 for storage thereof.

In accordance with the present invention, when the reagent solution fluid level of the reagent solution contained in the collection compartment falls below a predetermined operational fluid level, the fill pump 18 automatically transfers the rinsing/reagent run-off fluids collected in the storage compartment 17 to the collection compartment 15. In this manner, the reagent solution is automatically replenished to the predetermined operational fluid level without filling the collection compartment 15 with costly uncontaminated de-ionized water. The de-ionized water source 60, therefore, will be primarily reserved to supply finishing rinse procedure.

The phosphatizing assembly 13 preferably includes maximum and minimum fluid level sensors 64, 64' (FIG. 3) in fluid communication with the reagent solution. These sensors, preferably float switches, are deployed to indicate the desired minimum and maximum operational fluid level of the phosphatizing reagent solution in the collection compartment 15. Thus, when the actual reagent fluid level falls below a minimum operational fluid level of the reagent solution, the control unit 50 will instruct the fill pump 18 to transfer a portion of the rinsing/reagent solution stored in the storage compartment to the reagent solution circulating in the collection compartment. The fill pump 18 may continue to operate until the actual reagent fluid level rises near the maximum operational fluid level. Once the maximum fluid level sensor 64 detects the maximum reagent fluid level of the reagent solution, the control unit 50 will shut-off the fill pump 18.

This drain pump 68 may be employed to periodically drain the collection compartment for maintenance purposes, or when changing the reagent solution.

This generally will occur when the operator determines the reagent (e.g., phosphoric acid in the phosphate solution) to be spent. When the drain switch is activated, the control unit 50 may cut off the electricity to virtually every function except the drain pumps for cautionary purposes. This also may be implemented by a low level flow switch, in instances were the water heater 27 may be exposed. Once the collection compartment is drained, the operator may activate the FILL switch to fill the compartment with either rinsing/reagent solution from the storage compartment, initially, or from directly from the rinse solution source 60.

The waste tank 70 is preferably provided by a conventional evaporator such as an emergent style heater system. Any other waste disposal units may be employed, however.

It will further be appreciated that the storage assembly 16 also includes maximum and minimum fluid level sensors 69, 69' preferably float switches, which sense desired minimum and maximum operating fluid levels of the rinsing/reagent solutions in the storage compartment 17. Thus, in the event the collection compartment 15 requires refilling, the fill pump 19 will operate until the reagent fluid level in the collection compartment is full, or until the actual rinsing/reagent fluid level falls below the minimum operational fluid level of the rinsing/reagent solution, as indicated by the minimum fluid level sensor 69' in the storage assembly 16. Subsequently, in this instance, the control unit 50 will instruct the fill pump 19 to stop operation. Moreover, if the rinsing/reagent fluid level were already below the minimum operational fluid level of the rinsing/reagent solution, operation of the fill pump 19 would not commence. In these circumstances, the control unit 50 of the phosphatizing system 10 may instruct fill valve 63 to move to the open condition. The de-ionized water source 60 would then supply the collection compartment 15 with uncontaminated de-ionized water. This fill arrangement is also employed to fill the collection compartment 15 with de-ionized water when the reagent solution is being changed, for example.

Finally, when the maximum fluid level sensor 69 of the storage assembly 16 detects that the actual rinsing/reagent fluid level has surpassed the maximum operational fluid level of the rinsing/reagent solution therein, the control unit 50 will instruct an auto-dump pump 71 to operate. This pump 71 is fluidly coupled between the storage compartment 17 and the waste tank 70, and may continue to operate until the actual rinsing/reagent fluid level falls between the maximum and minimum operational fluid level of the storage assembly 16. Preferably, however, this dump pump 71 is instructed to operate for a predetermined period of time to remove a preset volume of rinsing/reagent solution from the storage compartment. This auto-dump pump 71, moreover, may be employed to periodically drain the storage compartment for maintenance purposes.

In another aspect of the present invention, a method is provided for phosphatizing an object 9 with a reagent solution including the steps of: supporting the object 9 through a subfloor assembly 11 including a support floor 23 having a run-off portion 12 thereof; and performing a phosphatizing procedure on the object through a phosphatizing assembly 13 by passing a phosphatizing reagent solution over the object. The next steps include: directing excess reagent run-off fluids into a collection compartment 15 of the phosphatizing assembly 13 for reuse thereof; and after the performing a phosphatizing procedure step, performing a finishing rinse procedure on the object 9 through a storage assembly 16 by passing a rinsing solution over the object 9. The next steps of the present invention include directing excess rinsing/reagent run-off fluids into a storage compartment 17 of the storage assembly; and selectively transferring a portion of the rinsing/reagent run-off fluids collected in the storage compartment 17 to the collection compartment 15 when the reagent solution contained therein drops below a predetermined operation.

The phosphatizing step may be performed in a combined cleaning/phosphatizing procedure, employing a high pressure spray application for cleaning and a low pressure spray application for phosphatizing.

The phosphatizing step preferably includes the step of spraying the object 9, while the rinsing step preferably includes the step of spraying the object with a rinsing solution of uncontaminated de-ionized water. Moreover, before the first directing step and the second directing step, the present invention method includes the step of flowing the run-off fluids into a transfer compartment 36 in fluid communication between the run-off portion 12, the collection compartment 15 and the storage compartment 17 for selective diversion of the reagent run-off fluids to the collection compartment 15 and selective diversion of the rinsing/reagent run-off fluids to the storage compartment 17, respectively.

In another aspect of the method of the present invention, the first directing step and the second directing step are performed by a transfer valve mechanism 42 movable between a first position, allowing passage of the run-off fluids to the collection compartment 15 while simultaneously preventing passage thereof to the storage compartment 17, and a second position, allowing passage of the run-off fluids to the storage compartment 17 while simultaneously preventing passage thereof to the collection compartment 15.

The method of the present invention further includes the step of detecting the presence of run-off fluids in the transfer compartment 36, and in response to run-off fluid detection, operating the transfer pump 40 for one of the first pumping step and the transfer pumping step. Moreover, the method includes the step of delaying the shut-off of the transfer pump 40 for a predetermined time period when the non-presence of the run-off fluids in the transfer compartment are detected.

In still another configuration, the method includes the step of automatically performing the transferring step upon detection of the reagent solution fluid level in the collection compartment 15 falling below the predetermined operational fluid level.

In another aspect of the method of the present invention, when an operator initially starts up the cleaning system 10, should the fluid level sensors in the collection compartment detect a reagent solution fluid level below the operational fluid level, the auto-fill feature will directly fill the collection compartment with rinsing/reagent solution from the storage assembly 16, or directly with uncontaminated reagent solution (E.g., fresh de-ionized water) from the rinse solution source 60.

The auto-fill feature will initially access the storage compartment 17 for rinsing/reagent solution. However, in the event the rinsing/reagent fluid level is below the minimum operational fluid level in the storage compartment, the control unit 50 will instruct the system to access the rinse solution source 60 for uncontaminated reagent solution.

What is claimed is:

1. A phosphatizing system for phosphatizing an object comprising:

a floor assembly for supporting an object, and adapted to direct excess run-off fluids which are flowed over the object towards a run-off portion of the floor assembly;

a closed-loop phosphatizing assembly configured to pass a phosphatizing reagent solution over the object during a phosphatizing procedure, and having a collection compartment in fluid communication with the run-off portion for receipt of substantially all the reagent run-off fluids from said floor assembly;

a storage assembly configured to pass a rinsing solution over the object to wash the reagent solution therefrom during a finishing rinse procedure performed after the phosphatizing procedure, and having a storage compartment in fluid communication with the run-off portion for receipt of substantially all of a rinsing/reagent run-off fluids from said object onto the floor assembly;

a fill pump in fluid communication between the collection compartment and the storage compartment to transfer the rinsing/reagent run-off fluids collected in the storage compartment to the collection compartment when the reagent fluid level of a reagent solution contained therein falls below a predetermined operational fluid level; and a transfer compartment in fluid communication between the runoff-portion, the collection compartment and the storage compartment for selective diversion of the reagent run-off fluids to the collection compartment and the rinsing/reagent run-off fluids to the storage compartment.

2. The phosphatizing system as defined in claim 1 wherein, said transfer compartment includes a valve mechanism movable between a first position, directing the reagent run-off fluids to the collection compartment, and a second position, directing the rinsing/reagent run-off fluids to the storage compartment.

3. The phosphatizing system as defined in claim 2 further including:

a transfer pump in fluid communication between the transfer compartment and the valve mechanism to pump the run-off fluids from the transfer compartment to one of the collection compartment and the storage compartment.

4. The phosphatizing system as defined in claim 3 wherein, said transfer compartment includes a fluid sensor configured to detect the presence of run-off fluids in the transfer compartment, and in response to run-off fluid detection, said fluid sensor is adapted to communicate with said transfer pump for operation thereof.

5. The phosphatizing system as defined in claim 4 further including:

a timer device coupled to transfer pump to delay the shut-off thereof for a predetermined time period when said fluid sensor detects the non-presence of the run-off fluids in the transfer compartment.

6. The phosphatizing system as defined in claim 1 further including:

a filtering device positioned between the run-off portion and said transfer compartment to filter out relatively coarse contaminants.

7. The phosphatizing system as defined in claim 6 wherein, the filtering device is a mesh basket.

8. The phosphatizing system as defined in claim 1 wherein, said phosphatizing procedure is performed through a spray application.

9. The phosphatizing system as defined in claim 8 wherein, said phosphatizing assembly is further adapted for a combined pressure wash/phosphatizing spray application.

10. The phosphatizing system as defined in claim 9 wherein, said combined pressure wash/phosphatizing spray application is performed through a pressure spray wand.

11. The phosphatizing system as defined in claim 9 wherein, said reagent solution includes a phosphoric acid component and a de-ionized water component, and said rinsing solution is composed of de-ionized water.

12. The phosphatizing system as defined in claim 8 wherein, said finishing rinse procedure is performed through a spray application.

13. The phosphatizing system as defined in claim 1 further including:

an auto-fill device adapted to automatically operate the fill pump upon detection of the reagent fluid level in the collection compartment falling below the predetermined operational fluid level.

14. The phosphatizing system as defined in claim 13 wherein, said storage assembly includes an upper level sensor for sensing a predetermined upper level of collected rinsing/reagent solution in the storage compartment, and a lower level sensor for sensing a predetermined lower level of the collected rinsing/reagent, said lower level sensor being communicably coupled to said fill pump for shut-off thereof upon detection of the rinsing/reagent fluid level of the collected rinsing/reagent solution in the storage compartment falling below the predetermined lower level.

15. The phosphatizing system as defined in claim 9 wherein, said phosphatizing assembly further includes a heating element in fluid contact with the collected reagent solution in said collection compartment for controlled heating thereof.

16. The phosphatizing system as defined in claim 1 wherein, said floor assembly includes a support floor adapted to direct the run-off fluids toward the run-off portion thereof.

17. A cleaning system for cleansing an object comprising:

a floor assembly for supporting an object, and adapted to direct excess run-off fluids which are flowed over the object towards a run-off portion of the floor assembly;

a closed-loop cleaning assembly configured to pass a wetting solution over the object during a wetting procedure, and having a collection compartment in fluid communication with the run-off portion for receipt of substantially all the wetting run-off fluids from said floor assembly;

a storage assembly configured to pass a de-ionized water rinsing solution over the object to wash the wetting solution therefrom during a finishing rinse procedure performed after the wetting procedure, and having a storage compartment in fluid communication with the run-off portion for receipt of substantially all of a rinsing/wetting run-off fluids from said object onto the floor assembly;

a fill pump in fluid communication between the collection compartment and the storage compartment to transfer the rinsing/wetting run-off fluids collected in the storage compartment to the collection compartment when the wetting solution fluid level of a wetting solution contained therein falls below a predetermined operational fluid level; and a transfer compartment in fluid communication between the runoff-portion, the collection compartment and the storage compartment for selective diversion of the wetting run-off fluids to the collection compartment and the rinsing/wetting run-off fluids to the storage compartment.

18. The cleaning system as defined in claim 17 wherein, said transfer compartment includes a valve mechanism movable between a first position, directing the wetting run-off fluids to the collection compartment, and a second position, directing the rinsing/wetting run-off fluids to the storage compartment.

19. The cleaning system as defined in claim 18 further including:

a transfer pump in fluid communication between the transfer compartment and the valve mechanism to pump the run-off fluids from the transfer compartment to one of the collection compartment and the storage compartment.

20. The cleaning system as defined in claim 19 wherein, said transfer compartment includes a fluid sensor configured to detect the presence of run-off fluids in the transfer compartment, and in response to run-off fluid detection, said fluid sensor be adapted to communicate with said transfer pump for operation thereof.

21. The cleaning system as defined in claim 20 further including:

a timer device coupled to transfer pump to delay the shut-off thereof for a predetermined time period when said fluid sensor detects the non-presence of the run-off fluids in the transfer compartment.

22. The cleaning system as defined in claim 17 further including:

a filtering device positioned between the run-off portion and said transfer compartment to filter out relatively coarse contaminants.

23. The cleaning system as defined in claim 17 further including:

an auto-fill device adapted to automatically operate the fill pump upon detection of the reagent fluid level in the collection compartment falling below the predetermined operational fluid level.

24. A cleaning system for cleansing an object comprising:

a floor assembly for supporting an object, and adapted to direct excess run-off fluids which are flowed over the object towards a run-off portion of the floor assembly;

a closed-loop cleaning assembly configured to pass a wetting solution over the object during a wetting procedure, and having a collection compartment in fluid communication with the run-off portion for receipt of substantially all the wetting run-off fluids from said floor assembly;

a storage assembly configured to pass a de-ionized water rinsing solution over the object to wash the wetting solution therefrom during a finishing rinse procedure performed after the wetting procedure, and having a storage compartment in fluid communication with the run-off portion for receipt of substantially all of a rinsing/wetting run-off fluids from said object onto the floor assembly;

a fill pump in fluid communication between the collection compartment and the storage compartment to transfer the rinsing/wetting run-off fluids collected in the storage compartment to the collection compartment when the wetting solution fluid level of a wetting solution contained therein falls below a predetermined operational fluid level;

an upper level sensor for sensing a predetermined upper level of the rinsing/wetting run-off fluids in the storage compartment; and a lower level sensor for sensing a predetermined lower level of the rinsing/wetting run-off fluids, said lower level sensor being communicably coupled to said fill pump for shut-off thereof upon detection of the rinsing/wetting fluid level of the rinsing/wetting run-off fluids in the storage compartment falling below the predetermined lower level.

25. The cleaning system as defined in claim 24 further including:

a transfer compartment in fluid communication between the runoff-portion, the collection compartment and the storage compartment for selective diversion of the reagent run-off fluids to the collection compartment and the rinsing/wetting run-off fluids to the storage compartment.

26. The cleaning system as defined in claim 25 wherein, said transfer compartment includes a valve mechanism movable between a first position, directing the reagent run-off fluids to the collection compartment, and a second position, directing the rinsing/wetting run-off fluids to the storage compartment.

27. The cleaning system as defined in claim 26 further including:

a transfer pump in fluid communication between the transfer compartment and the valve mechanism to pump the run-off fluids from the transfer compartment to one of the collection compartment and the storage compartment.

28. The cleaning system as defined in claim 27 wherein, said transfer compartment includes a fluid sensor configured to detect the presence of run-off fluids in the transfer compartment, and in response to run-off fluid detection, said fluid sensor be adapted to communicate with said transfer pump for operation thereof.

29. The cleaning system as defined in claim 25 further including:

a filtering device positioned between the run-off portion and said transfer compartment to filter out relatively coarse contaminants.

30. A cleaning system for cleansing an object comprising:

a floor assembly for supporting an object, and adapted to direct excess run-off fluids which are flowed over the object towards a run-off portion of the floor assembly;

a closed-loop cleaning assembly configured to pass a wetting solution over the object during a wetting procedure, and having a collection compartment in fluid communication with the run-off portion for receipt of substantially all the wetting run-off fluids from said floor assembly;

a storage assembly configured to pass a de-ionized water rinsing solution over the object to wash the wetting solution therefrom during a finishing rinse procedure performed after the wetting procedure, and having a storage compartment in fluid communication with the run-off portion for receipt of substantially all of a rinsing/wetting run-off fluids from said object onto the floor assembly; and a transfer compartment in fluid communication between the runoff-portion, the collection compartment and the storage compartment for selective diversion of the reagent run-off fluids to the collection compartment and the rinsing/wetting run-off fluids to the storage compartment.

31. The cleaning system as defined in claim 30 wherein, said transfer compartment includes a valve mechanism movable between a first position, directing the reagent run-off fluids to the collection compartment, and a second position, directing the rinsing/wetting run-off fluids to the storage compartment.

32. The cleaning system as defined in claim 31 further including:

a transfer pump in fluid communication between the transfer compartment and the valve mechanism to pump the run-off fluids from the transfer compartment to one of the collection compartment and the storage compartment.

33. The cleaning system as defined in claim 32 wherein, said transfer compartment includes a fluid sensor configured to detect the presence of run-off fluids in the transfer compartment, and in response to run-off fluid detection, said fluid sensor be adapted to communicate with said transfer pump for operation thereof.

* * * * *